US006324124B1

(12) United States Patent
Yuzuki

(10) Patent No.: US 6,324,124 B1
(45) Date of Patent: Nov. 27, 2001

(54) ELECTRONIC TIMEPIECE

(75) Inventor: Toshiyuki Yuzuki, Chiaba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/328,110

(22) Filed: Jun. 8, 1999

(30) Foreign Application Priority Data

Jun. 9, 1998 (JP) ..... 10-161176

(51) Int. Cl.[7] ..... G04C 19/00; G04B 19/00
(52) U.S. Cl. ..... 368/82; 368/223
(58) Field of Search ..... 368/10, 82–84, 368/223, 239–242, 250, 251

(56) References Cited

U.S. PATENT DOCUMENTS 3,834,153 * 9/1974 Yoda et al. ..... 58/38
4,354,260 * 10/1982 Planza ..... 368/10
4,362,392 * 12/1982 Kumata ..... 368/82
4,483,628 * 11/1984 Terzian ..... 368/82

FOREIGN PATENT DOCUMENTS 2480958 4/1980 (FR) .
2028547 3/1980 (GB) .
57-181590 11/1982 (JP) .
58-66890 4/1983 (JP) .
2-9318 3/1990 (JP) .
3040174 5/1997 (JP) .

* cited by examiner

*Primary Examiner*—Vit Miska
(74) *Attorney, Agent, or Firm*—Adams & Wilks

(57) ABSTRACT

An electronic timepiece has a display driver circuit for driving a display panel having plural display portions for displaying information corresponding to plural functions executed by the timepiece. The display driver circuit turns off one or more display portions corresponding to active functions when a timekeeping function requiring continuous visual recognition is being executed by the timepiece so that a display corresponding to the function requiring continuous visual recognition may be viewed without distraction by a display corresponding to other functions. The function requiring continuous visual recognition may be a stopwatch function, a timer function or other elapsed time function, and the other functions having an ON/OFF state set by one or more input switches.

55 Claims, 10 Drawing Sheets

ELECTRONIC TIMEPIECE

BACKGROUND OF THE INVENTION

1. Field of the Invention

The present invention relates to an electronic timepiece having a plurality of functions for displaying displays showing states of setting these functions on a display portion.

2. Description of the Prior Art

Generally, according to an electronic timepiece having a plurality of functions of an alarm function, a timer function, a stopwatch (chronograph) function and the like, not only time is displayed on a display portion but also marks indicating states of setting these functions, that is, states of ON/OFF are simultaneously displayed. FIG. 9 shows a display in a state in which a chronograph mode is selected in a conventional electronic timepiece. In FIG. 9, a chronograph 51 and current time 52 are displayed on a display portion 50. Further, a summer time mark 53 indicating an ON state of setting summer time, an alarm mark 54 indicating an ON state of an alarm function, a confirming sound mark 55 indicating an ON state of a confirming sound or a time informing sound function in operating an operation button (not illustrated) of an electronic timepiece and a lamp mark 56 indicating an ON state of lamps for illuminating the display portion, are turned on. In this case, there are functions other than the functions represented by the turned-on marks and these functions indicate an OFF state, that is, a state in which marks representing these functions are turned off.

FIG. 10 is a flowchart showing a displaying processing of the alarm mark 54 in the conventional electronic timepiece. The displaying processing is one of periodical display updating processings which are carried out in respect of all of displays on the display portion 50. In reference to FIG. 10, it is firstly determined whether the alarm function is set to ON (step S201). When the alarm function is set to ON at step S201, the alarm mark 54 is turned on (step S202) and the processing in the flowchart is finished. When the alarm function is not set to ON at step S201, the alarm mark 54 is turned off (step S203) and the processing in the flowchart is finished.

In respect of marks with regard to other functions of the confirming sound mark 55, the lamp mark 56 and so on, processings similar to that in the flowchart of FIG. 10 are repeatedly carried out. By the displays of these marks, it can be easily determined what function is currently made ON in the electronic timepiece.

Further, according to the conventional electronic timepiece, for example, the alarm function is a function dependent on current time and accordingly, it is not appropriate to operate the function during a time period in which a time correcting mode for correcting time is selected and an operation of correcting time is being carried out and in this case, even when the alarm function is set to ON, the ON state is forcibly changed into the OFF state and simultaneously, the alarm mark is turned off.

According to the conventional electronic timepiece explained above, in the case in which a number of functions are provided and the functions are set to the ON state, a number of marks or the like displayed on the display portion becomes also large. In the case in which when the electronic timepiece is used by setting a large number of the provided functions to the ON state, a function needing continuous visual recognition of the display portion, for example, the chronograph function or the like is realized, function marks are turned on other than that of the chronograph display portion to which attention is to be paid and the visual recognition performance is not necessarily regarded as excellent.

Particularly, in the case of an electronic timepiece of a portable type such as a wrist watch or the like, a display region of the display portion is limited and the above-described problem of the visual recognition performance becomes significant. For example, when the chronograph display and the current time display are simultaneously displayed at positions different from each other, it is difficult to instantaneously discriminate them from each other since shapes of these displays are similar to each other. Further, monochromatic liquid crystals are frequently used as the display portion and in recognizing visually the display of the chronograph or the like which is repeatedly updated continuously and at high speed, function marks turned on at a surrounding of the chronograph display portion are not necessarily be needed.

The present invention has been carried out in view of inconvenience provided in the conventional technology and it is an object of the invention to provide an electronic timepiece for promoting visual recognition performance when a function needing visual recognition of a display portion continuously such as the chronograph function or the like is realized.

SUMMARY OF THE INVENTION

In order to resolve the above-described problem and achieve the object, according to a first constitution of the invention, there is provided an electronic timepiece characterized in that in an electronic timepiece having a plurality of functions when a function for carrying out an operation needing continuous visual recognition is being executed, a display in respect of other than the function is turned off.

According to the constitution, when the function for carrying out the operation needing the continuous visual recognition is being executed, the display in respect of other than the function is turned off and accordingly, the visual recognition performance can be promoted with regard to the display in respect of the operation of the function.

Further, according to a second constitution of the invention, there is provided an electronic timepiece characterized in that in an electronic timepiece having a plurality of functions when a function for carrying out an operation needing continuous visual recognition is being executed, a display at a surrounding of a display at least in respect of the function among displays in respect of other than the function is turned off.

According to the constitution, when the function for carrying out the operation needing the continuous visual recognition is being executed, the display at the surrounding of the display at least in respect of the function in the displays with regard to other than the function is turned off and accordingly, the visual recognition performance can be promoted with regard to the display in respect of the operation of the function.

Further, according to a third constitution of the invention, there is provided an electronic timepiece characterized in that in an electronic timepiece having a plurality of functions when one function for carrying out an operation needing continuous visual recognition is being executed, displays in respect of other than the one function are turned off and when a notification is needed in an operation of other function, a display in respect of the notification is turned on.

According to the constitution, when the one function for carrying out the operation needing the continuous visual recognition is being executed, the displays in respect of other than the function are turned off and when the notification is needed in the operation of the other function, the display in respect of the notification is turned on and accordingly, the visual recognition performance can be promoted with regard to the display in respect of the operation of the function and further, the operation of the other function can be achieved.

Further, according to a fourth constitution of the invention, there is provided an electronic timepiece characterized in that in an electronic timepiece having a plurality of functions when one function for carrying out an operation needing continuous visual recognition is being executed, a display at a surrounding of a display in respect of at least the one function among displays in respect of other than the one function is turned off and when a notification is needed in an operation of other function, a display in respect of the notification is turned on.

According to the constitution, when the one function for carrying out the operation needing the continuous visual recognition is being executed, the display at the surrounding of the display at least in respect of the function is turned off among the displays in respect of other than the function and when the notification is needed in the operation of the other function, the display in respect of the notification is turned on and accordingly, the visual recognition performance can be promoted with regard to the display in respect of the operation of the function and the operation of the other function can be achieved.

Further, according to a fifth constitution of the invention, there is provided the electronic timepiece according to any one of the first through the fourth constitutions, characterized in that the one function is a time interval measuring function.

According to the constitution, particularly in the case in which the time measuring function is being executed, the displays in respect of other than the time measuring function are turned off and accordingly, the visual recognition performance can be promoted with regard to the display in respect of the operation of the time measuring function.

BRIEF DESCRIPTION OF THE DRAWINGS

A preferred for of the present invention is illustrated in the accompanying drawings in which.

DETAILED DESCRIPTION OF THE PREFERRED EMBODIMENTS

A detailed explanation will be given of embodiments of an electronic timepiece according to the invention in reference to the drawings as follows. Further, the invention is not limited by the embodiments.

Figure 1:
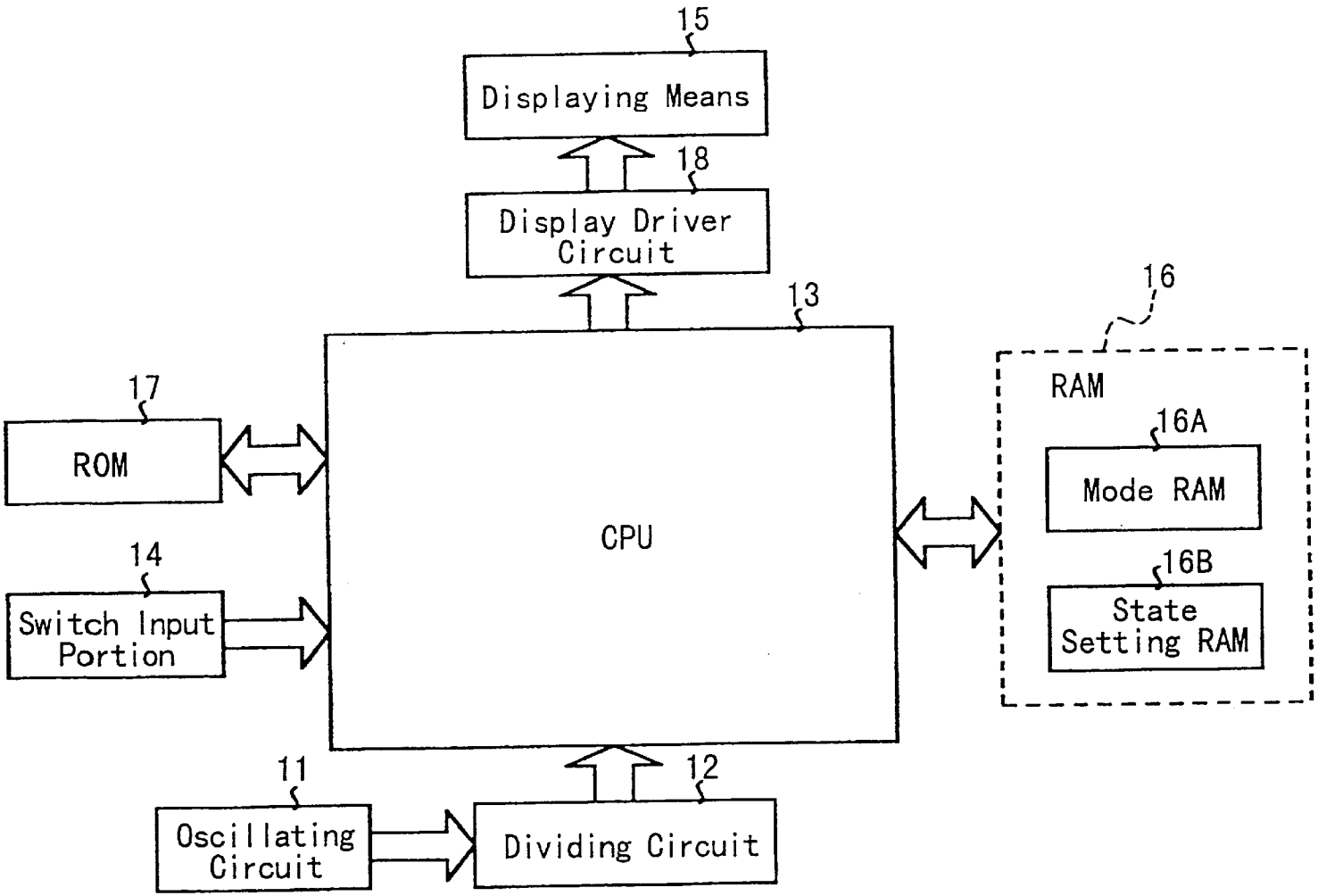
FIG. 1 is a block diagram showing an outline constitution of an electronic timepiece according to an embodiment.

FIG. 1 is a block diagram showing an outline constitution of an electronic timepiece according to the invention. In FIG. 1, an electronic timepiece according to the invention is constituted by displaying means 15 for enabling time display or displays necessary for realizing other functions, a display driver circuit 18 for driving the displaying means 15, ROM 17 stored with programs for realizing a time display or other functions, a switch input portion 14 for realizing selection of functions or various inputting processings by a user, a central processing unit (CPU) 13 for realizing the functions based on the programs stored in ROM 17 and transmitting display signals to the display driver circuit 18 for displaying these functions on the displaying means 15, an oscillating circuit 11 for forming a clock for accurately driving CPU 13 and a clock necessary for measuring time and a dividing circuit 12 for supplying CPU 13 with a clock having a desired frequency by dividing the clock provided from the oscillating circuit 11.

Further, the electronic timepiece according to the invention is installed with RAM 16 for storing states of setting respective functions with regard to a plurality of functions and CPU 13 displays displays in accordance with the respective functions on the displaying means 15 by referring to the set states stored in RAM 16. Further, RAM 16 includes a mode RAM 16A for storing information of currently selected functions carrying major operation, that is, selected modes and a state setting RAM 16B for storing states of setting respective functions.

As kinds of modes stored in the mode RAM 16A, there are pointed out a time correcting mode, a chronograph mode, a timer mode and the like. That is, the modes signify functions which need to continuously update displays on the displaying means 15 with instruction from a user via the switch input portion 14 as a trigger.

Figure 2:
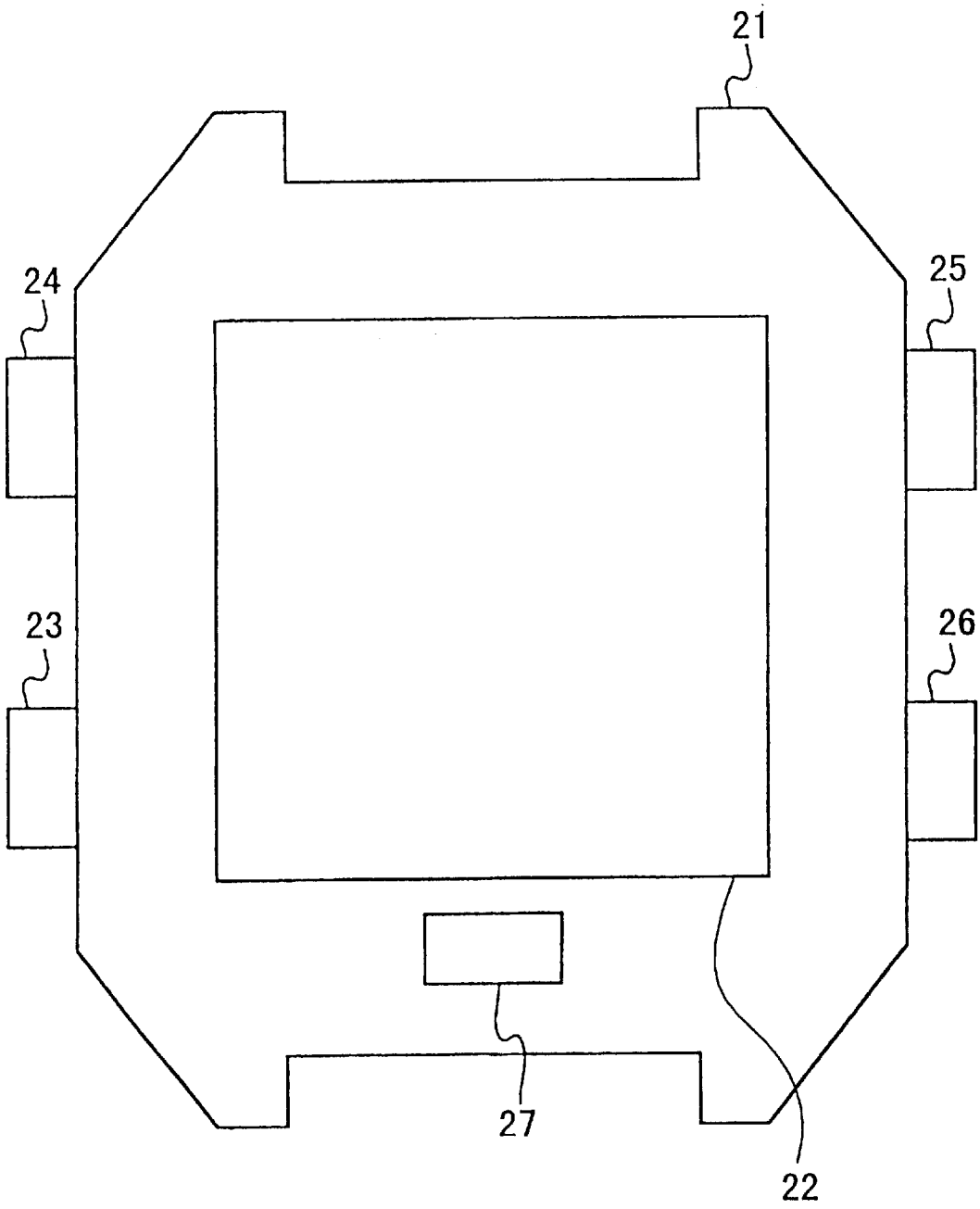
FIG. 2 is a view showing a case portion of the electronic timepiece according to the embodiment.

FIG. 2 shows a case portion of the electronic timepiece according to the invention. In FIG. 2, input buttons 23 through 27 correspond to the switch input portion 14, mentioned above and may be arranged on side faces of the case portion 21 as in the input buttons 23 through 26 or may be arranged at a front face as in the input button 27. These input buttons are classified respectively into, for example, a mode select button for selecting modes, a start button and a stop button for further constituting triggers of start and finish of operation of a function in a selected mode, a shift button functioning only by a combination thereof with other button and so on. Further, a display necessary for realizing a function is displayed on a display portion 22.

Figure 3:
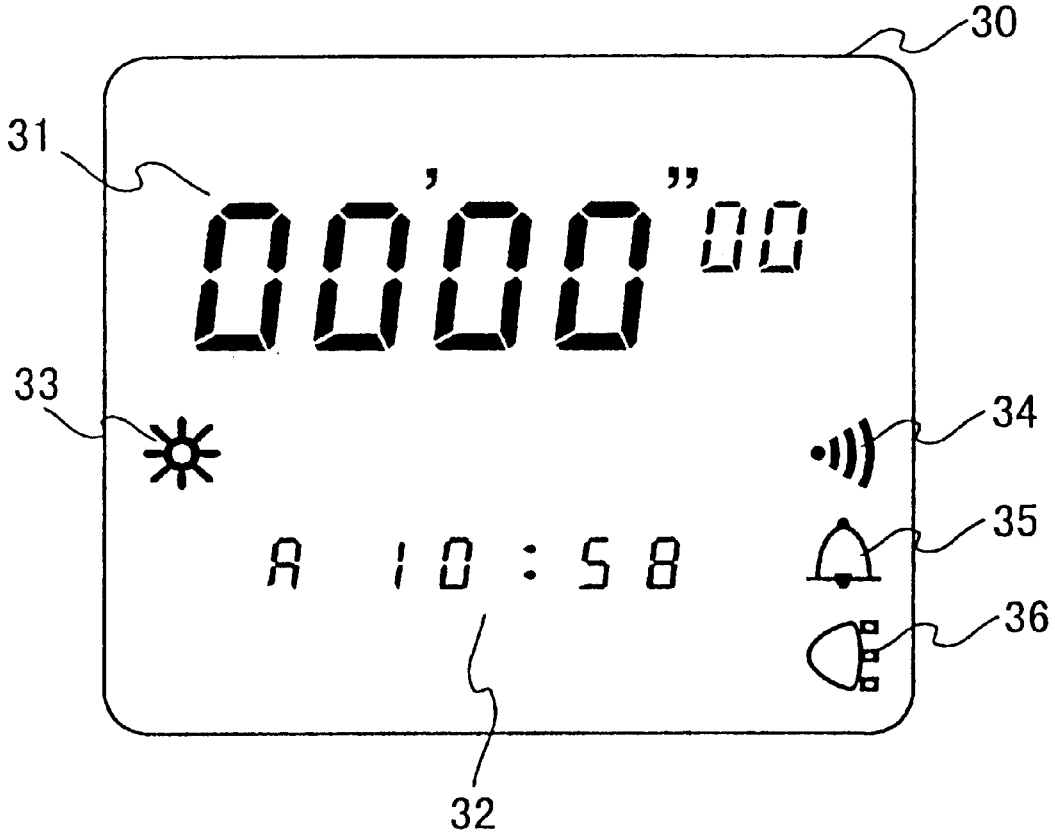
FIG. 3 is a view for explaining operation of the electronic timepiece according to the embodiment.

FIG. 3 shows a display in a state of selecting the chronograph mode in the electronic timepiece according to the invention. In FIG. 3, the chronograph 31 and current time 32 are displayed on a display portion 30. Further, a summer time mark 33 indicating an ON state of setting summer time, an alarm mark 34 indicating an ON state of an alarm function, a confirming sound mark 35 indicating an ON state of a confirming sound or a time informing sound function in operating the input buttons 23 through 27 shown by FIG. 2 and a lamp mark 36 indicating an ON state of lamps for illuminating the display portion, are turned on. In this case, there are functions other than the functions represented by the turned-on marks and these functions indicate an OFF state, that is, states in which marks representing these functions are turned off.

Figure 4:
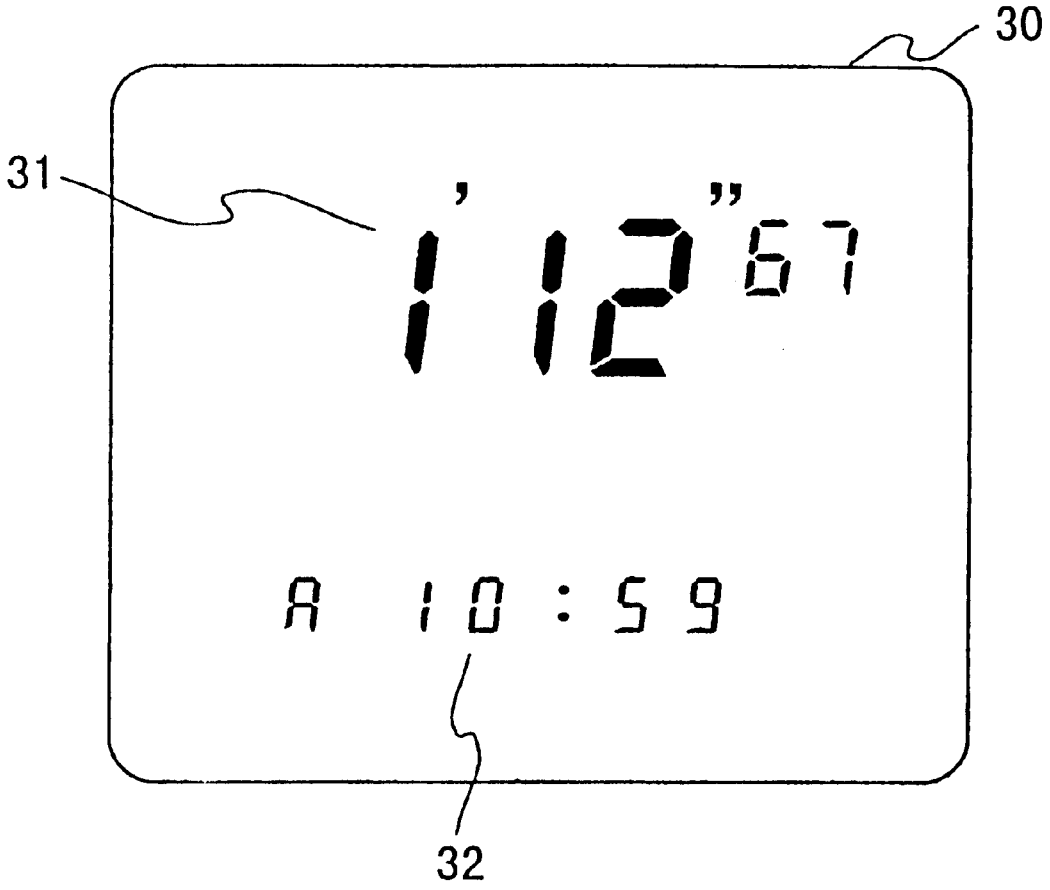
FIG. 4 is a view for explaining operation of the electronic timepiece according to the embodiment.

FIG. 3 particularly shows a state of resetting the chronograph mode and the chronograph function is not executed. The chronograph function is executed only when any of the input buttons 23 through 27 is operated. That is, time measurement is started. FIG. 4 shows a display state of the display portion 30 in executing the chronograph function.

At this occasion, during a time period in which the chronograph 31 continuously carries out time display in accordance with elapse of time, the summer time mark 33, the alarm mark 34, the confirming sound mark 35 and the lamp mark 36 which have been turned on in FIG. 3, that is, in the state of resetting the chronograph mode, are turned off.

Thereby, the visual recognition performance of the chronograph 31 is promoted and even when a user looks away from the display portion 30 and again looks at the display portion 30, the user can pay attention to the chronograph 31 instantaneously. Although in FIG. 4, the current time 32 is displayed, it may be turned off.

Further, by operating any of the input buttons 23 through 27, the function of the chronograph is stopped and by operating the input button for bringing the chronograph mode into the reset state, the display on the display portion 30 shown by FIG. 3 is again recovered. That is, by finishing the time measurement and resetting the chronograph 31, the marks indicating the functions set in the ON state are again turned on.

Particularly, the operation of turning off the function marks in executing the chronograph function does not signify that the functions set in the ON state are not changed into the OFF state. Therefore, in the case in which in executing the chronograph function, for example, the current time reaches the alarm set time in the alarm function in the ON state, the alarm mark 34 is turned on and the alarm sound is emitted by which the user can be notified thereof. Further, the alarm mark 34 may not only be turned off but may be winked.

Figure 5:
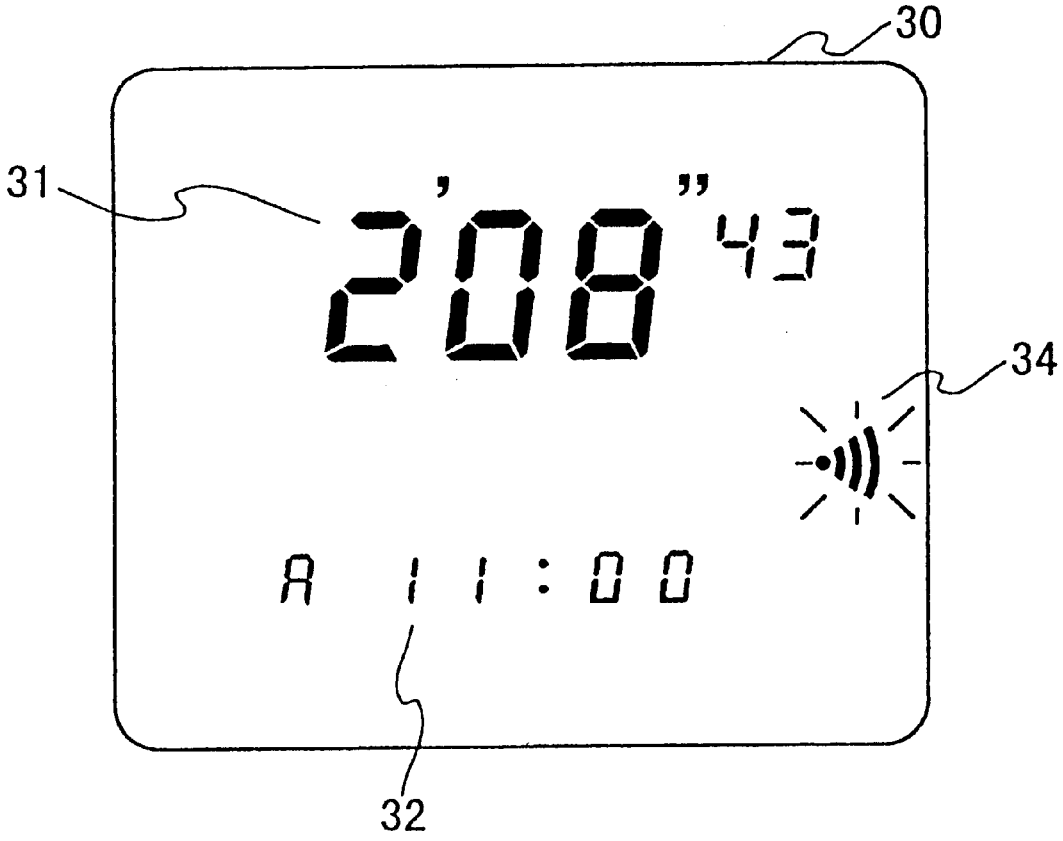
FIG. 5 is a view for explaining operation of the electronic timepiece according to the embodiment.

FIG. 5 shows a display state of the display portion 30 when the alarm set time and the current time coincide with each other in executing the chronograph function and the alarm function stays in the ON state.

Figure 6:
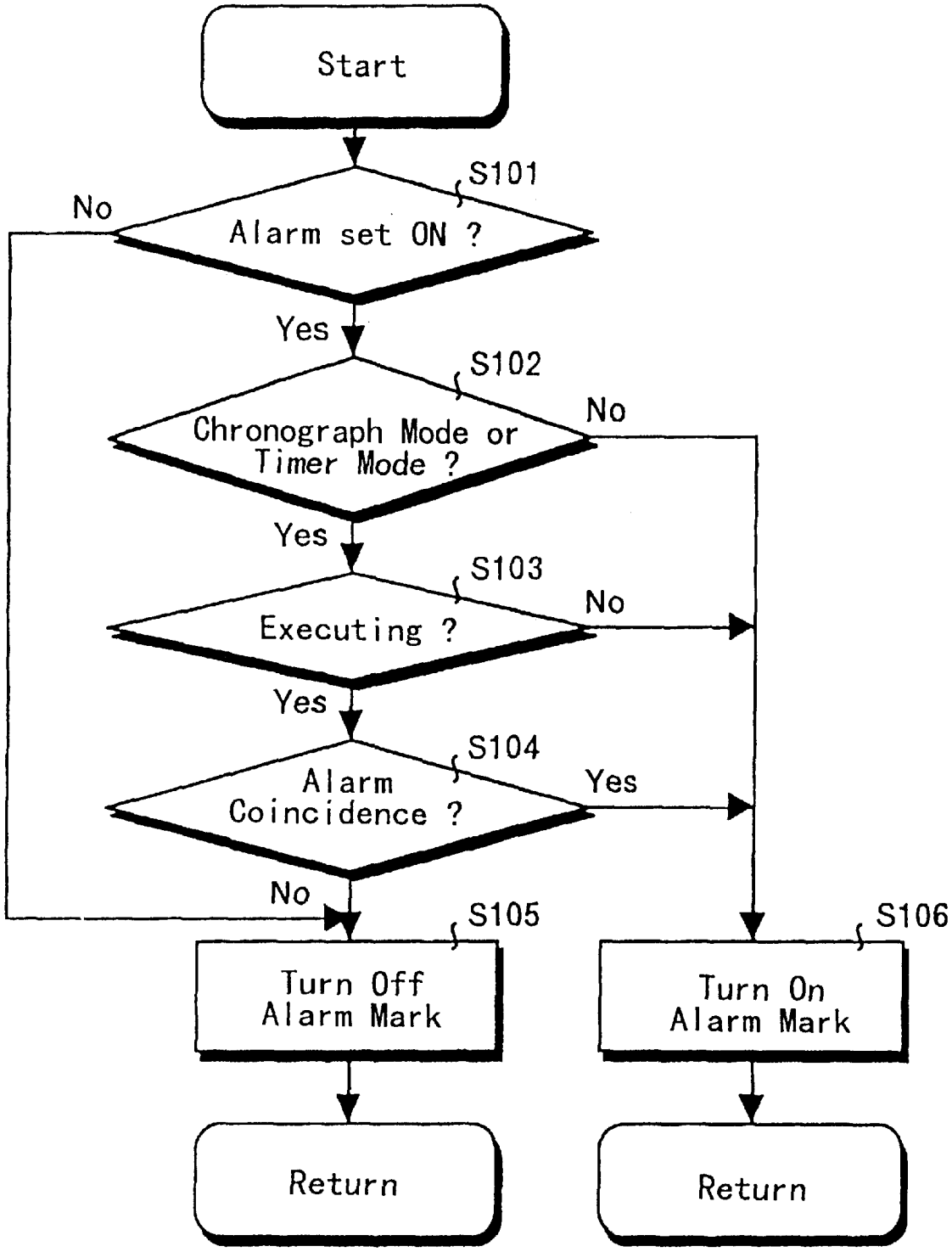
FIG. 6 is a flowchart for explaining the operation of the electronic timepiece according to the embodiment.

Processings of turning on and turning off the function marks explained above are carried out based on the programs stored in ROM 17. FIG. 6 is a flowchart showing the display processing of the alarm mark 34 in the electronic timepiece according to the invention. The display processing is one of periodical display updating processings which are carried out in respect of all of displays on the display portion 30. In FIG. 6, firstly, whether the alarm function is set to ON Is determined by referring to the state setting RAM 16B (step S101). When the alarm function is not set to ON in step S101, the alarm mark 34 is turned off (step S105) and the processing in the flowchart is finished.

When the alarm function is set to ON in step S101, whether a currently selected mode is the chronograph mode or the timer mode is determined by referring to the mode RAM 16A (step S102). When the currently selected mode is the chronograph mode or the timer mode in step S102, it is determined further whether the mode is being carried out (in this case, measuring time) (step S103).

In step S103, in a case in which the selected mode is being executed, it is further determined whether the case is a case in which the current time reaches alarm set time in the alarm function, that is, the alarm time coincides with the current time (step S104). When the alarm time does not coincide with the current time at step S104, the alarm mark 34 is turned off (step S105) and the processing in the flowchart is finished.

When the currently selected mode is not the chronograph mode or the timer mode at step S102, when the selected mode is not being executed in step S103 and when the alarm time coincides with the current time at step S104, the alarm mark 34 is turned on (step S106) and the processing in the flowchart is finished. Further, processings similar to that In the flowchart shown by FIG. 6 are repeatedly carried out in respect of marks with regard to other functions such as the confirming sound mark 35, the lamp mark 36 and so on.

Therefore in executing the function needing the continuous visual recognition such as the chronograph mode, the timer mode or the like, the visual recognition performance is promoted by erasing marks indicating other functions set in the ON state and when notification of alarm or the like is needed in the other functions set in the ON state, the mark indicating the notification (normally, a function mark serves also as the mark) can be turned on and the notification of coincidence of the alarm time with the current time or the like to the user is achieved.

Figure 7:
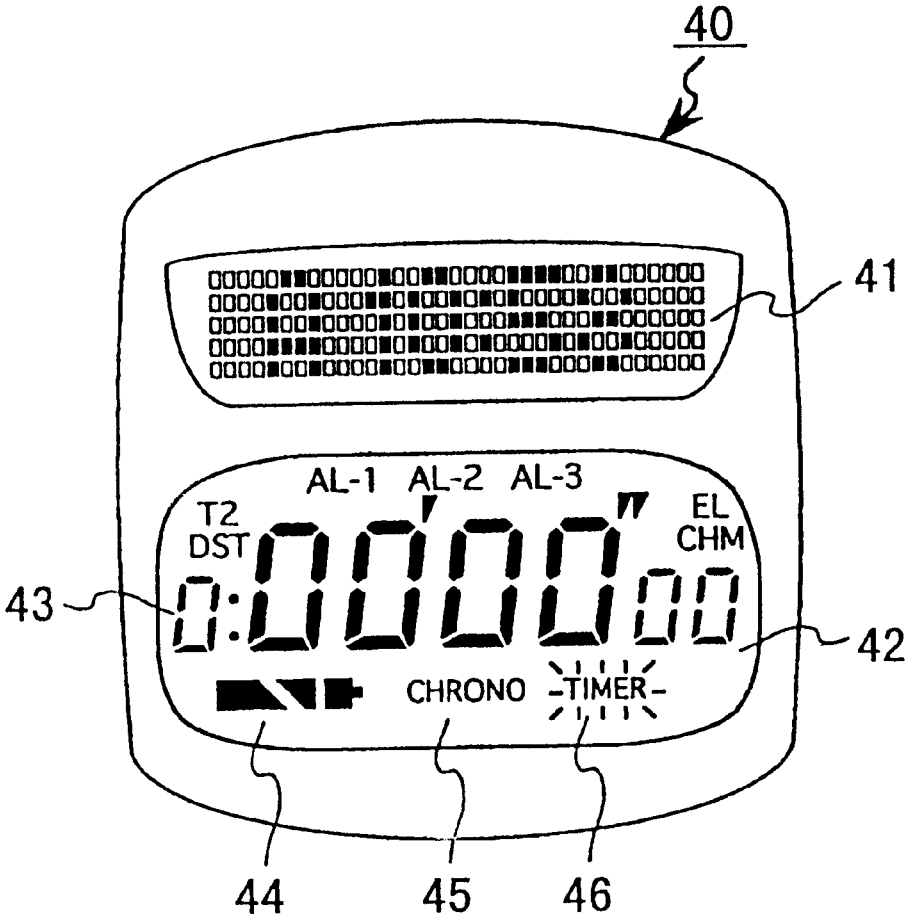
FIG. 7 is a view for explaining operation of an electronic timepiece according to other embodiment.

Although according to the embodiment explained above, as shown by FIG. 3, time, function marks and so on are displayed in the single display portion 30, as other embodiment, as in a display portion 40 shown by FIG. 7, a display region 41 and a display region 42 which are different from each other may be provided and displays different from each other may be carried out. In this case, the display region 41 can display current time and the display region 42 can display chronograph or timer 43, a battery remaining capacity display 44, a chronograph mode mark 45, a timer mode mark 46 and letters or marks indicating other function setting states.

Figure 8:
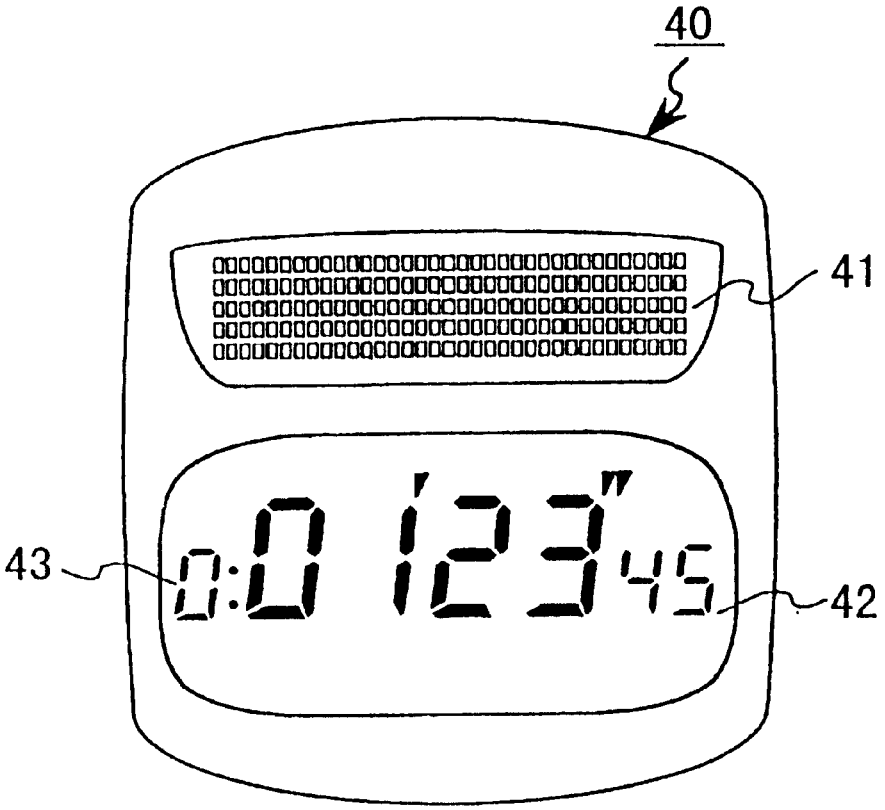
FIG. 8 is a view for explaining the operation of the electronic timepiece according to the other embodiment.
Figure 9:
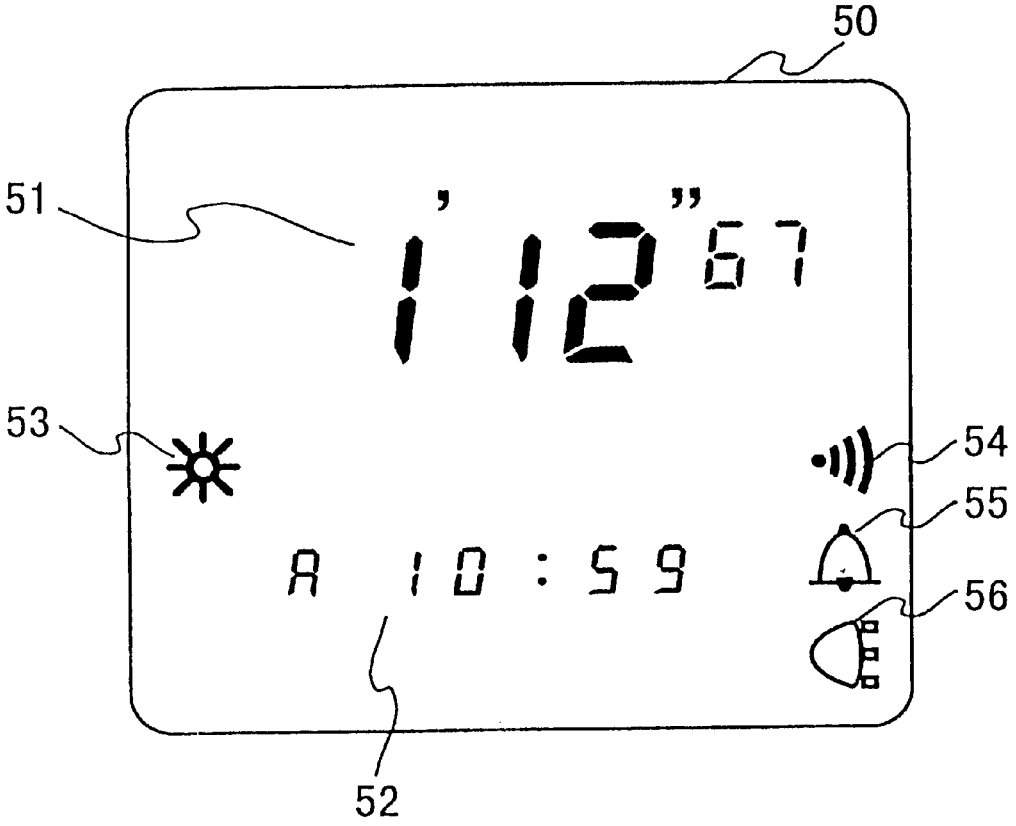
FIG. 9 is a view for explaining operation of a conventional electronic timepiece.
Figure 10:
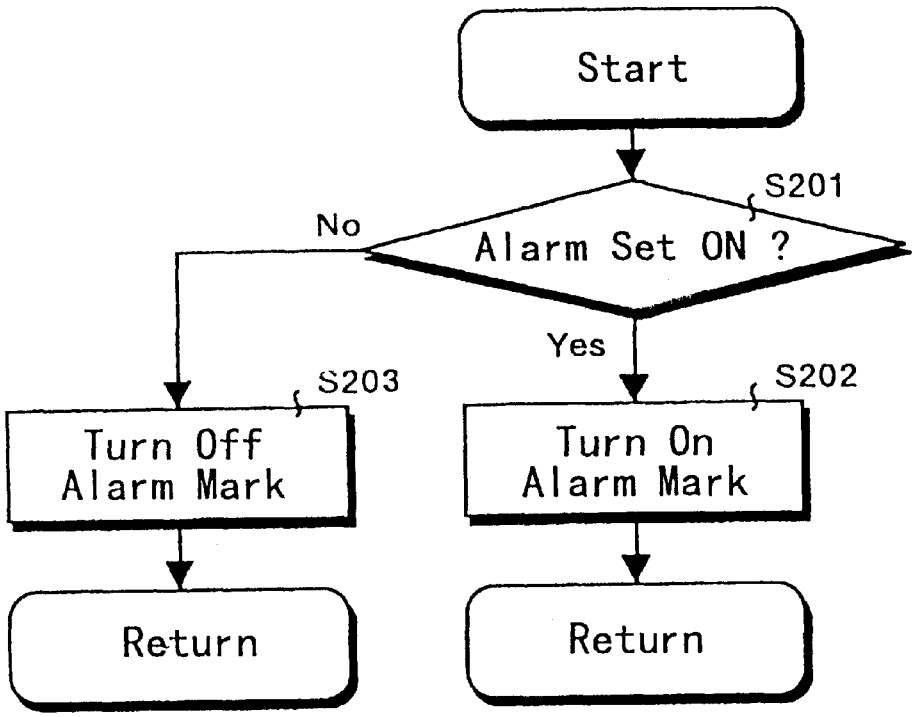
FIG. 10 is a flowchart for explaining the operation of the conventional electronic timepiece.

According to the display portion 40 shown by FIG. 8, when the timer mode is currently selected and the timer mode is executed, display on the display region 41 is turned off and display of other than the timer 43 is turned off on the display region 42. Further, when a notification is needed in other functions set in the ON state, a mark indicating the notification (normally, a function mark serves also as the mark) is turned on. Further, in the case of the embodiment, the display on the display region 41 may be turned on and a portion in the display of other than the timer 43 may be turned off on the display region 42.

According to the first constitution of the invention, when the function for carrying out the operation needing the continuous visual recognition is being executed, a display in respect of other than the function is turned off and accordingly, the visual recognition performance can be promoted with regard to the display in respect of the operation of the function.

Further, according to the second constitution of the invention, when the function for carrying out the operation needing the continuous visual recognition is being executed, the display at the surrounding of the display at least in respect of the function in the displays in respect of other than the function is turned off and accordingly, the visual recognition performance can be promoted with regard to the display in respect of the operation of the function.

Further, according to the third constitution of the invention, when the one function for carrying out the operation needing the continuous visual recognition is being executed, the displays in respect of other than the function are turned off and when the notification is needed in the operation of the other function, the display in respect of the notification is turned on and accordingly, the visual recognition performance can be promoted with regard to the display in respect of the operation of the function and the operation of the other function can be achieved.

Further, according to the fourth constitution of the invention, when the one function for carrying out the operation needing the continuous visual recognition is being executed, the display at the surrounding of the display with regard to at least the function in the displays in respect of other than the function is turned off and when the notification is needed in the operation of the other function, the display in respect of the notification is turned on and accordingly, the visual recognition performance can be promoted with regard to display in respect of the operation of the function and the operation of the other function can be achieved.

Further, according to the fifth constitution of the invention, particularly when the time measuring function is being executed, the displays in respect of other than the time measuring function are turned off and accordingly, the visual recognition performance can be promoted with regard to the display in respect of the operation of the time measuring function.

What is claimed is:

1. In a multi-function electronic timepiece having a display device for providing a different visual display for each of a plurality of functions: control means for controlling the display device such that when a given function requiring a continuous visual display is selected but is not being executed, visual displays associated with other functions are enabled, and when the given function is selected and is being executed, the visual displays associated with the other functions are disabled so that only the visual display associated with the given function is provided on the display device.

2. An electronic timepiece according to claim 1; wherein the function requiring a continuous visual display comprises a stopwatch function.

3. An electronic timepiece according to claim 2; wherein the other functions comprise a timer function, a current time display function, and an alarm function.

4. An electronic timepiece according to claim 1; wherein the function requiring a continuous visual display comprises a timer function.

5. An electronic timepiece according to claim 1; wherein the function requiring a continuous visual display comprises an elapsed time measurement function.

6. An electronic timepiece according to claim 1; wherein the plurality of functions comprise selectable timekeeping functions; and further comprising one or more input switches for selecting a visual display associated with each of the plural functions and for setting the ON/OFF state for execution of each of the plural functions.

7. An electronic timepiece according to claim 1; further comprising a processing circuit for executing the plural functions, a memory for storing a program executed by the processing circuit and mode data corresponding to user selected modes of operation of the plural functions, a display driver circuit for driving the display in accordance with an output of the processing circuit, an oscillator circuit for producing a clock signal, a divider circuit for dividing the clock signal to produce a divided clock signal having a desired frequency for driving the processing circuit, and input switches for selecting a visual display associated with each of the plural functions and setting the ON/OFF state for execution of each of the plural functions.

8. An electronic timepiece according to claim 7; wherein the plural functions comprise a time correcting function, a chronograph function, an alarm function, and a timer function.

9. An electronic timepiece according to claim 1; wherein the control means controls the display device such that when the visual displays corresponding to each of the plurality of functions are enabled they are continuously updated.

10. An electronic timepiece according to claim 1; wherein the plurality of functions comprise resettable timekeeping functions at least one of which requires a continuous visual display during execution thereof, and the other functions include at least one non-timekeeping function.

11. An electronic timepiece according to claim 1; wherein the plurality of functions comprise resettable timekeeping functions at least one of which requires a continuous visual display during execution thereof; and further comprising one or more input switches for selecting a visual display associated with each of the resettable timekeeping functions and for setting the ON/OFF state for execution of the resettable timekeeping functions.

12. An electronic timepiece according to claim 11; wherein the resettable timekeeping functions comprise a stopwatch function and a timer function.

13. In a multi-function electronic timepiece having a display device for providing a different visual display for each of a plurality of functions: control means for controlling the display device such that when a given function requiring a continuous visual display is selected but is not being executed, visual displays associated with other functions at portions of the display device surrounding the portion used by the given function are enabled, and when the given function is selected and is being executed, the visual displays at the surrounding portions of the display device associated with the other functions are disabled so that only the visual display associated with the selected function is provided on the display device.

14. An electronic timepiece according to claim 13; wherein the function requiring a continuous visual display comprises a stopwatch function.

15. An electronic timepiece according to claim 13; wherein the other functions comprise a timer function, a current time display function, and an alarm function.

16. An electronic timepiece according to claim 13; wherein the function requiring a continuous visual display comprises a timer function.

17. An electronic timepiece according to claim 13; wherein the function requiring a continuous visual display comprises an elapsed time measurement function.

18. An electronic timepiece according to claim 13; wherein the plurality of functions comprise selectable timekeeping functions; and further comprising one or more input switches for selecting a visual display associated with each of the plural functions and for setting the ON/OFF state for execution of each of the plural functions.

19. An electronic timepiece according to claim 13; further comprising a processing circuit for executing the plural functions, a memory for storing a program executed by the processing circuit and mode data corresponding to user selected modes of operation of the plural functions, a display driver circuit for driving the display in accordance with an output of the processing circuit, an oscillator circuit for producing a clock signal, a divider circuit for dividing the clock signal to produce a divided clock signal having a desired frequency for driving the processing circuit, and input switches for selecting a visual display associated with each of the plural functions and setting the ON/OFF state for execution of each of the plural functions.

20. An electronic timepiece according to claim 19; wherein the plural functions comprise a time correcting function, a chronograph function, an alarm function, and a timer function.

21. An electronic timepiece according to claim 13; wherein the control means controls the display device such that when the visual displays corresponding to each of the plurality of functions are enabled they are continuously updated.

22. An electronic timepiece according to claim 13; wherein the plurality of functions comprise resettable timekeeping functions at least one of which requires a continuous visual display during execution thereof; and further comprising one or more input switches for selecting a visual display associated with each of the resettable timekeeping functions and for setting the ON/OFF state for execution of the resettable timekeeping functions.

23. An electronic timepiece according to claim 22; wherein the resettable timekeeping functions comprise a stopwatch function and a timer function.

24. In a multi-function electronic timepiece having a display device for providing a different visual display for each of a plurality of functions: control means for controlling the display device such that when a given function requiring a continuous visual display is selected but is not being executed, visual displays associated with other functions are enabled, when the given function is selected and is being executed, the visual displays associated with the other functions are disabled so that only the visual display associated with the selected function is provided on the display device, and execution of the given function and a notification is needed in connection with operation of the other function, a visual display providing the notification is provided.

25. An electronic timepiece according to claim 24; wherein the function requiring a continuous visual display comprises a stopwatch function.

26. An electronic timepiece according to claim 24; wherein the other functions comprise a timer function, a current time display function, and an alarm function.

27. An electronic timepiece according to claim 24; wherein the function requiring a continuous visual display comprises a timer function.

28. An electronic timepiece according to claim 24; wherein the function requiring a continuous visual display comprises an elapsed time measurement function.

29. An electronic timepiece according to claim 24; wherein the plurality of functions comprise selectable timekeeping functions; and further comprising one or more input switches for selecting a visual display associated with each of the plural functions and for setting the ON/OFF state for execution of each of the plural functions.

30. An electronic timepiece according to claim 24; further comprising a processing circuit for executing the plural functions, a memory for storing a program executed by the processing circuit and mode data corresponding to user selected modes of operation of the plural functions, a display driver circuit for driving the display in accordance with an output of the processing circuit, an oscillator circuit for producing a clock signal, a divider circuit for dividing the clock signal to produce a divided clock signal having a desired frequency for driving the processing circuit, and input switches for selecting a visual display associated with each of the plural functions and setting the ON/OFF state for execution of each of the plural functions.

31. An electronic timepiece according to claim 30; wherein the plural functions comprise a time correcting function, a chronograph function, an alarm function, and a timer function.

32. An electronic timepiece according to claim 24; wherein the control means controls the display device such that when the visual displays corresponding to each of the plurality of functions are enabled they are continuously updated.

33. An electronic timepiece according to claim 24; wherein the plurality of functions comprise resettable timekeeping functions at least one of which requires a continuous visual display during execution thereof; and further comprising one or more input switches for selecting a visual display associated with each of the resettable timekeeping functions and for setting the ON/OFF state for execution of the resettable timekeeping functions.

34. An electronic timepiece according to claim 33; wherein the resettable timekeeping functions comprise a stopwatch function and a timer function.

35. In a multi-function electronic timepiece having a display device for providing a different visual display for each of a plurality of functions: control means for controlling the display device such that when a given function requiring a continuous visual display is selected but is not being executed, visual displays associated with other functions at portions of the display device surrounding the portion used by the given function are enabled, when the given function is selected and is being executed, visual displays at the surrounding portions of the display device associated with the other functions are disabled so that only the visual display associated with the selected function is provided on the display device, and when one of the other functions is selected during execution of the given function and a notification is needed in connection with operation of the other function, a visual display providing the notification is provided.

36. An electronic timepiece according to any one of claims 1 through 35; wherein the function requiring a continuous visual display is a time interval measuring function.

37. An electronic timepiece according to claim 35; wherein the function requiring a continuous visual display comprises a stopwatch function.

38. An electronic timepiece according to claim 35; wherein the other functions comprise a timer function, a current time display function, and an alarm function.

39. An electronic timepiece according to claim 35; wherein the function requiring a continuous visual display comprises a timer function.

40. An electronic timepiece according to claim 35; wherein the function requiring a continuous visual display comprises an elapsed time measurement function.

41. An electronic timepiece according to claim 35 wherein the plurality of functions comprise selectable timekeeping functions; and further comprising one or more input switches for selecting a visual display associated with each of the plural functions and for setting the ON/OFF state for execution of each of the plural functions.

42. An electronic timepiece according to claim 35; further comprising a processing circuit for executing the plural functions, a memory for storing a program executed by the processing circuit and mode data corresponding to user selected modes of operation of the plural functions, a display driver circuit for driving the display in accordance with an output of the processing circuit, an oscillator circuit for producing a clock signal, a divider circuit for dividing the clock signal to produce a divided clock signal having a desired frequency for driving the processing circuit, and input switches for selecting a visual display associated with each of the plural functions and setting the ON/OFF state for execution of each of the plural functions.

43. An electronic timepiece according to claim 42; wherein the plural functions comprise a time correcting function, a chronograph function, an alarm function, and a timer function.

44. An electronic timepiece according to claim 35; wherein the control means controls the display device such that when the visual displays corresponding to each of the plurality of functions are enabled they are continuously updated.

45. An electronic timepiece according to claim 35; wherein the plurality of functions comprise resettable timekeeping functions at least one of which requires a continuous visual display during execution thereof; and further comprising one or more input switches for selecting a visual display associated with each of the resettable timekeeping functions and for setting the ON/OFF state for execution of the resettable timekeeping functions.

46. An electronic timepiece according to claim 45; wherein the resettable timekeeping functions comprise a stopwatch function and a timer function.

47. In a multi-function timepiece having a display driver circuit for driving a display panel having plural display portions for displaying information corresponding to a plurality of functions performed by the timepiece: wherein the display driver circuit disables one or more display portions corresponding to active functions when a given timekeeping function requiring continuous visual recognition is being executed by the timepiece so that a display corresponding to the function requiring continuous visual recognition may be viewed without distraction by a display corresponding to other functions, and the display driver circuit enables the one or more display portions corresponding to the active functions when the given timekeeping function is selected but is not being executed.

48. A timepiece according to claim 47; wherein the function requiring continuous visual recognition comprises a stopwatch function.

49. A timepiece according to claim 47; wherein the function requiring continuous visual recognition comprises a timer function.

50. A timepiece according to claim 47; wherein the function requiring continuous visual recognition comprises an elapsed time measurement function.

51. A timepiece according to claim 47; wherein the plurality of functions comprise selectable timekeeping functions; and further comprising one or more input switches for selecting a visual display associated with each of the plural functions and for setting the ON/OFF state for execution of each of the plural functions.

52. A timepiece according to claim 47; wherein the display driver circuit controls the display panel so that when one of the other functions is selected during execution of the given function and a notification is needed in connection with operation of the other function, a visual display providing the notification is provided turned on.

53. A multi-function timepiece comprising: a circuit for performing plural user-selectable functions including one or more timekeeping functions at least one of which requires a continuous visual display during execution thereof; a display device; and a control circuit for controlling the display device to provide a different visual display for each of the plural functions such that when a function requiring a continuous visual display is selected but is not being executed visual displays associated with the other functions are enabled, and when the given function is being executed visual displays associated with the other functions are disabled.

54. A multi-function timepiece according to claim 53; wherein the plurality of functions comprise resettable timekeeping functions at least one of which requires a continuous visual display during execution thereof; and further comprising one or more input switches for selecting a visual display associated with each of the resettable timekeeping functions and for setting the ON/OFF state of the resettable timekeeping functions.

55. An electronic timepiece according to claim 54; wherein the resettable timekeeping functions comprise a stopwatch function and a timer function.

* * * * *